US008217594B2

(12) United States Patent
Hu et al.

(10) Patent No.: US 8,217,594 B2
(45) Date of Patent: Jul. 10, 2012

(54) LIGHT EMITTING DEVICE WITH VARIABLE VOLUME

(75) Inventors: Lu Hu, Taipei (TW); Zhenyuan Liu, Taipei (TW); Wen-Chi Kuo, Taipei (TW)

(73) Assignees: Protek (shanghai) Limited, Pudong Kangqiao Industrial Zone, Shanghai (CN); Pegatron Corporation, Beitou District, Taipei (TW)

( * ) Notice: Subject to any disclaimer, the term of this patent is extended or adjusted under 35 U.S.C. 154(b) by 184 days.

(21) Appl. No.: 12/844,820

(22) Filed: Jul. 27, 2010

(65) Prior Publication Data

US 2011/0074298 A1 Mar. 31, 2011

(30) Foreign Application Priority Data

Sep. 29, 2009 (TW) ..... 98217968 U

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/307; 315/291; 315/302; 315/308

(58) Field of Classification Search ..... None
See application file for complete search history.

(56) References Cited

U.S. PATENT DOCUMENTS

| | | | | |
|---|---|---|---|---|
| 6,012,826 | A | 1/2000 | Chabert | |
| 6,371,638 | B1 | 4/2002 | Zingale | |
| 6,966,676 | B2 | 11/2005 | Chabert | |
| 7,364,488 | B2 * | 4/2008 | Mueller et al. | 446/220 |
| 2008/0169956 | A1 * | 7/2008 | Matsuyama et al. | 341/176 |
| 2010/0147994 | A1 * | 6/2010 | Nguyen et al. | 244/31 |

FOREIGN PATENT DOCUMENTS

| | | | |
|---|---|---|---|
| CN | 2542923 | Y | 4/2003 |

* cited by examiner

*Primary Examiner* — Anh Tran
(74) *Attorney, Agent, or Firm* — Winston Hsu; Scott Margo

(57) ABSTRACT

This invention provides a light emitting device with variable volume. The light emitting device includes a main body with variable volume, a sensor, a light emitting element, and a controller. The sensor is disposed in the main body for generating a volume measuring signal. The light emitting element is disposed in the main body. The controller is coupled with the light emitting element and the sensor. The controller controls brightness of the light emitting element according to the volume measuring signal.

8 Claims, 2 Drawing Sheets

LIGHT EMITTING DEVICE WITH VARIABLE VOLUME

CROSS-REFERENCE TO RELATED APPLICATIONS

This Non-provisional application claims priority under 35 U.S.C. §119(a) on Patent Application No(s). 098217968 filed in Taiwan, Republic of China Sep. 29, 2009, the entire contents of which are hereby incorporated by reference.

BACKGROUND OF THE INVENTION

1. Field of the Invention

This invention relates to a light emitting device and, more particularly, to a light emitting device with variable volume.

2. Description of the Related Art

Light emitting devices are necessary electronic devices in life. A conventional light emitting device usually includes a lightshade, a light bulb, and a knob switch. The lightshade usually has a fixed shape. The light bulb is disposed in the lightshade, and the knob switch is coupled with the light bulb. In use, the brightness of the light bulb can be controlled by the knob switch.

However, the appearance of the light emitting device is monotonous. Further, users can adjust the brightness of the light emitting device only via the knob switch. The brightness control mode is monotonous, and interactivity is poor, further failing to provide intuitive using experience for the users.

BRIEF SUMMARY OF THE INVENTION

This invention provides a light emitting device with variable volume to improve the prior art.

This invention provides a light emitting device with variable volume including a main body with variable volume, a sensor, a light emitting element, and a controller. The sensor is disposed in the main body for generating a volume measuring signal. The light emitting element is disposed in the main body. The controller is coupled with the light emitting element and the sensor. The controller controls brightness of the light emitting element according to the volume measuring signal.

Compared with the light emitting device with a fixed shape in the prior art, the light emitting device in the invention has variable volume, thereby capable of providing a better visual effect. Further, the controller controls the brightness of the light emitting element according to the volume measuring signal generated by the sensor, thereby providing intuitive using experience that the brightness changes with the volume for users.

These and other features, aspects, and advantages of the present invention will become better understood with regard to the following description, appended claims, and accompanying drawings.

DETAILED DESCRIPTION OF THE INVENTION

Figure 1:
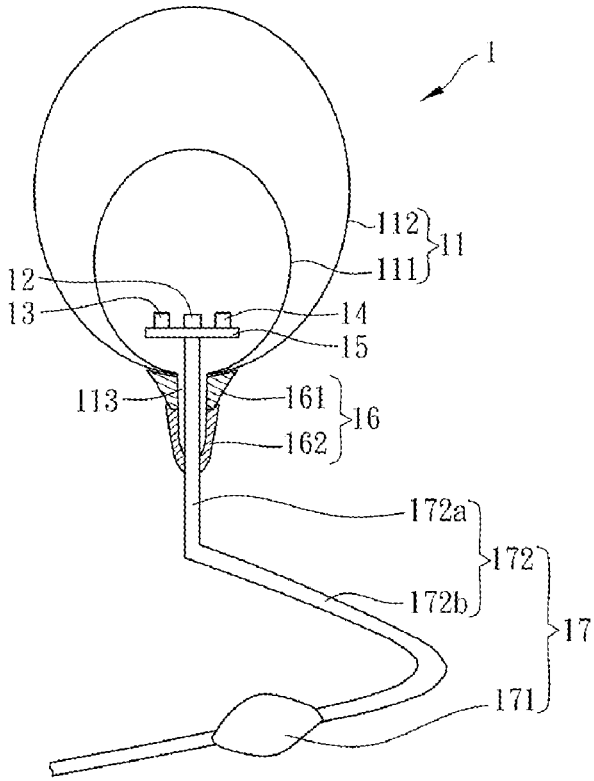
FIG. 1 is a schematic diagram showing a light emitting device with variable volume according to one preferred embodiment of the invention.

FIG. 1 is a schematic diagram showing a light emitting device with variable volume according to one preferred embodiment of the invention. In this embodiment, a light emitting device 1 includes a main body 11, a sensor 12, a light emitting element 13, a controller 14, a circuit board 15, a fastening element 16, and a volume control unit 17.

In the embodiment, the fastening element 16 and the volume control unit 17 can be coupled with the main body 11, respectively. The circuit board 15 can be disposed in the main body 11. The sensor 12, the light emitting element 13, and the controller 14 can be disposed on the circuit board 15. The sensor 12 and the light emitting element 13 can be coupled with the controller 14 via circuits (not shown) on the circuit board 15. However, the invention is not limited thereto.

In the embodiment, the main body 11 includes a supporting body 111 and a balloon 112. The supporting body 111 is a hollow body, and it may be spherical or ellipsoidal. Further, the supporting body 111 can be made of silica gel. However, the invention is not limited thereto. The balloon 112 is sleeved on the supporting body 111 and has better elasticity. However, the invention is not limited thereto.

In the embodiment, the main body 11 has an opening 113. Via the opening 113, gas such as air can be filled into the main body 11. Thereby, the volume of the main body 11 can change with the amount of the filled gas. However, the invention is not limited thereto. In other embodiments, the main body 11 may not have the opening 113, and the main body 11 may be made of a special material, further to change the volume of the main body 11 according to a theory of expanding with heat and contracting with cold.

In the embodiment, in detail, when the main body 11 is not filled with the gas, the balloon 112 is attached to the supporting body 111. At that moment, the main body 11 has the smallest volume corresponding to that of the space formed by the supporting body 111. When the main body 11 is filled with the gas, the balloon 112 gradually expands with increase of the filled gas. At that moment, the volume of the main body 11 corresponds to that of the balloon 112.

In the embodiment, the volume control unit 17 includes an air pump 171 and a pipe 172. The pipe 172 is connected with the main body 11, and the air pump 171 is disposed at the pipe 172. The volume of the main body 11 can be controlled by operating the air pump 171. In detail, when the air pump 171 is pressed, the gas enters into the main body 11 via the pipe 172, and the balloon 112 gradually expands with increase of the filled gas. When a switch of the air pump 171 is opened, the gas in the main body 11 can escape. Further, the balloon 112 contracts with increase of the escaping gas until the volume of the balloon 12 is equal to that of the space formed by the supporting body 111. However, the invention is not limited thereto. In other embodiments, the volume control unit 17 may not be disposed, and the volume of the main body 11 may be controlled via air blowing by people or via other auxiliary tools.

In the embodiment, the pipe 172 can include a hard portion 172*a* and a soft portion 172*b*. One end of the hard portion 172*a* is connected with the main body 11, and the other end is connected with the soft portion 172*b*. In the embodiment, the air pump 171 can be disposed at the soft portion 172*b*. Thereby, the whole light emitting device 1 can have a certain structural strength and can be flexible in shape. Further, via the soft portion 172*b*, a user can operate the light emitting device 1 at any place. However, the invention is not limited. In other embodiments, the pipe 172 may only include the hard portion 172*a* or may only include the soft portion 172*b*.

In the embodiment, one end of the hard portion 172*a* passes through the opening 113 and enters into the main body 11. Further, an outer diameter of the hard portion 172*a* can be substantially equal to the diameter of the opening 113. Thereby, the end of the hard portion 172*a* can seal the opening 113 to prevent the gas in the main body 11 from escaping.

In the embodiment, the circuit board 15 can be disposed at the end of the hard portion 172*a* entering into the main body 11. When the light emitting device 1 obtains power from an external power supply, wires (not shown) connected with the external power supply can be disposed in the pipe 172 and can be connected with the circuit board 15 by extending from the end of the hard portion 172*a*, thereby providing power for the circuit board 15 and each component disposed thereon. However, the invention is not limited thereto.

In the embodiment, the fastening element 16 is fastened to a periphery of the opening 113 to maintain the size of the opening 113. In detail, the fastening element 16 includes a clamping ring 161 and a fastening ring 162. The clamping ring 161 surrounds the periphery of the opening 113 to overcome contraction of the material of the balloon 112, thereby maintaining the size of the opening 113 to be the same as that of the clamping ring 161 all the time. One end of the fastening ring 162 is coupled with the clamping ring 161, and the other end is clamped at the hard portion 172*a* to allow the combining place of the volume control unit 17 and the main body 11 to maintain a relative stable state. However, the invention is not limited thereto.

In the embodiment, the sensor 12 senses the volume of the main body 11 and generates a volume measuring signal. The controller 14 receives the volume measuring signal, and then it generates a control signal to control the brightness of the light emitting element 13. The operation of the sensor 12 and the controller 14 is described hereinbelow in detail.

In the embodiment, the light emitting element 13 can be an LED light emitting element including an LED driver and an LED lamp. The controller 14 outputs the generated control signal to the LED driver, and then the LED driver drives the LED lamp to light. However, the invention is not limited thereto.

Figure 2:
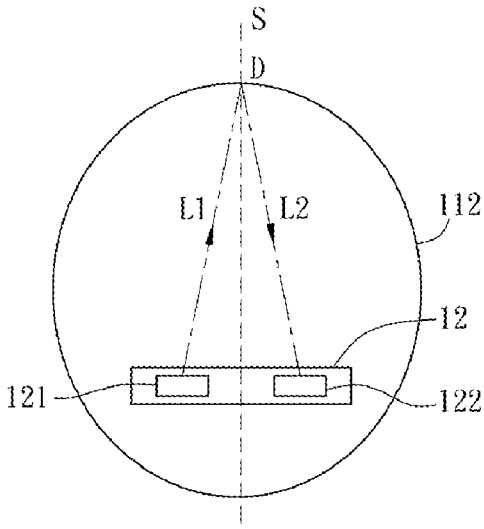
FIG. 2 is an operation schematic diagram showing a sensor according to one preferred embodiment of the invention.
Figure 3:
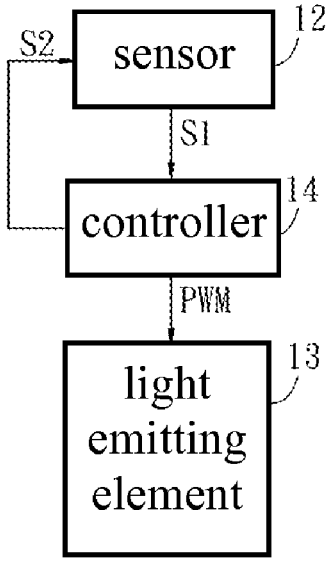
FIG. 3 is a functional block diagram showing a light emitting device according to one preferred embodiment of the invention.

FIG. 2 is an operation schematic diagram showing a sensor according to one preferred embodiment of the invention. FIG. 3 is a functional block diagram showing a light emitting device according to one preferred embodiment of the invention. Please refer to FIG. 1, FIG. 2, and FIG. 3 together.

In the embodiment, the sensor 12 is an infrared sensor including a transmitter 121 and a receiver 122. After the light emitting device 1 is connected with the power, the controller 14 is powered, and it transmits a start signal S2 to allow the sensor 12 to work. At that moment, the transmitter 121 can transmit infrared transmitted light L1 at a certain angle. The infrared transmitted light L1 is reflected back after touching the wall of the balloon 112. The receiver 122 receives infrared reflected light L2 of the infrared transmitted light L1, thereby generating a volume measuring signal S1 and outputting the volume measuring signal S1 to the controller 14. However, the invention is not limited thereto.

In the embodiment, the sensor 12 continuously transmits and receives the infrared light in a short period thus to allow the brightness of the light emitting element 13 to be capable of instantly corresponding to the present volume of the main body 11. However, the invention is not limited thereto.

In addition, the transmitting angle of the transmitter 121 is determined by a disposition place of the sensor 12 in the main body 11. In the embodiment, the sensor 12 can be located at a center line S of the main body 11, and the transmitter 121 and the receiver 122 can be symmetrically disposed at two sides of the center line S. Thereby, a reflecting point D where the infrared transmitted light L1 transmitted from the transmitter 121 is reflected at the main body 11 is a central top point of the balloon 112. However, the invention is not limited thereto. In other embodiments, the sensor 12 may be disposed at other places in the main body 11.

In the embodiment, when the volume of the main body 11 changes, that is, the balloon 112 expands or contracts, the distance between the sensor 12 and the reflecting point D increases or decreases synchronously. Thereby, the route from the transmission of the infrared transmitted light L1 from the transmitter 121 to the return of the infrared reflected light L2 to the receiver 122 lengthens or shortens therewith. Since the main body 11 is not a vacuum, the light transmitted in the gas has energy loss. Therefore, certain energy may be lost in the process that the infrared transmitted light L1 is transmitted from the transmitter 121 and the infrared reflected light L2 returns to the receiver 122. That is, the energy of the infrared reflected light L2 received by the receiver 122 is smaller than that of the infrared transmitted light L1 transmitted by the transmitter 121. Further, the longer the transmitting route is, the greater the energy loss is.

In the embodiment, the receiver 122 receives the infrared reflected light L2 and generates the volume measuring signal S1 which may be a voltage signal. However, the invention is not limited thereto. In other embodiments, the volume measuring signal S1 may be a current signal. In the embodiment, the strength of the voltage signal corresponds to the quality of the energy of the infrared reflected light L2. That is, the greater the volume of the main body 11 is, the smaller the energy of the infrared reflected light L2 is, the weaker the voltage signal is, and vice versa.

In the embodiment, the controller 14 can be a single chip. However, the invention is not limited thereto. The controller 14 can include an A/D converter (not shown). After the controller 14 receives the volume measuring signal S1, the A/D converter can first convert the volume measuring signal S1 to a digital signal, and then the controller 14 controls the brightness of the light emitting element 13 by using the digital signal as a parameter and according to an internal program.

In detail, the controller 14 can store a look-up table therein, and the look-up table can reflect the relation between a pulse duty rate and the volume measuring signal S1. Thereby, the controller 14 can obtain the pulse duty rate corresponding to the volume measuring signal S1 by looking up the table. Otherwise, the controller 14 can also directly calculate the pulse duty rate corresponding to the volume measuring signal S1 via a functional relation expression. However, the invention is not limited thereto. The controller 14 can transmit a control signal to control the brightness of the light emitting element 13 according to the calculated pulse duty rate.

In the embodiment, the control signal can be a pulse width modulation (PWM) signal. In detail, the controller 14 can transmit the corresponding PWM signal to a negative pole of the light emitting element 13 according to the calculated pulse duty rate, thus to control the light emitting element 13 to be in a light state during part time of a period of the PWM signal and to be in an extinguishing state during the other time of the period. Since human eyes cannot distinguish a frequency over 25 Hz, as long as the period is smaller than 0.04 s, the illumination of the light emitting element 13 may seem to be continuous via duration of vision of human eyes. Further, by controlling different pulse duty rates, the human eyes can feel different brightness. For example, when the pulse duty rate is 0.8, the human eyes can feel that the brightness of the light emitting element 13 is greater than that of the light emitting element 13 when the pulse duty rate is 0.3. However, the invention is not limited thereto.

In the embodiment, the brightness of the light emitting element 13 cannot increase without limitation. When the volume measuring signal S1 received by the controller 14 reaches to a critical value, the controller 14 can control the light emitting element 13 to maintain the brightness to which the critical value corresponds, i.e. the greatest brightness, according to an internal preset program. However, the invention is not limited thereto.

Figure 4:
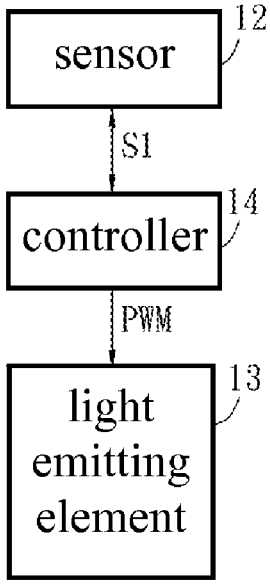
FIG. 4 is a functional block diagram showing a light emitting device according to another preferred embodiment of the invention.

FIG. 4 is a functional block diagram showing a light emitting device according to another embodiment of the invention. Please refer to FIG. 1 and FIG. 4 together.

In the embodiment, the sensor 12 is a pressure sensor for sensing air pressure in the main body 11 and outputting a corresponding volume measuring signal S1 to the controller 14. The sensor 12 and the controller 14 can communicate with each other via a 3-wire serial interface. However, the invention is not limited thereto.

In the embodiment, the sensor 12 can continuously sense the air pressure in the main body 11 during a short period to allow the brightness of the light emitting element 13 to be capable of instantly corresponding to the present volume of the main body 11. However, the invention is not limited thereto.

In the embodiment, when the volume of the main body 11 changes, the balloon 112 can expand or contract. At that moment, the air pressure in the main body 11 can synchronously increase or decrease. The pressure sensor generates and outputs the volume measuring signal S1 corresponding to the sensed air pressure. The volume measuring signal S1 can be a voltage signal. However, the invention is not limited thereto. In other embodiments, the volume measuring signal S1 may be a current signal.

In the embodiment, the controller 14 can be a single chip. However, the invention is not limited thereto. The controller 14 can include an A/D converter (not shown). After the controller 14 receives the volume measuring signal S1, the A/D converter can first convert the volume measuring signal S1 to a digital signal, and then the controller 14 can control the brightness of the light emitting element 13 by using the digital signal as a parameter and according to an internal program. The detailed embodiment is similar to that as shown in FIG. 2 and FIG. 3. Therefore, it is not described for a concise purpose.

To sum up, according to the light emitting device in the embodiment of the invention, the volume control unit can be used to change the volume of the main body. Compared with the light emitting device with a fixed shape in the prior art, the light emitting device in the invention can provide better visual effect. Further, the controller can control the brightness of the light emitting element according to the volume measuring signal generated by the sensor, thereby providing intuitive using experience that the brightness changes with the volume for the users. In addition, according to the light emitting device in the embodiment of the invention, the pipe connected with the main body can include the hard portion and the soft portion at the same time, which allows the light emitting device to have a certain structural strength and to be flexible in shape. Further, since the air pump can be disposed at the soft portion of the pipe, via elasticity of the soft portion, the users can operate the light emitting device at any place.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A light emitting device with variable volume comprising:

a first wireless module, comprising:

a main body with variable volume;

a sensor disposed in the main body for generating a volume measuring signal, wherein the sensor is an infrared sensor including a transmitter and a receiver;

a light emitting element disposed in the main body; and a controller coupled with the light emitting element and the sensor, the controller controlling brightness of the light emitting element according to the volume measuring signal.

2. The light emitting device with variable volume according to claim 1, further comprising a fastening element, the main body having an opening, the fastening element fastened to a periphery of the opening to maintain a size of the opening.

3. The light emitting device with variable volume according to claim 1, further comprising a volume control unit coupled with the main body for controlling the volume of the main body.

4. The light emitting device with variable volume according to claim 3, wherein the volume control unit comprises a pipe and an air pump, the pipe is connected with the main body, the air pump is disposed at the pipe, and the volume of the main body is controlled by operating the air pump.

5. The light emitting device with variable volume according to claim 4, wherein the pipe comprises a hard portion and a soft portion, the hard portion is connected with the main body, and the air pump is disposed at the soft portion.

6. The light emitting device with variable volume according to claim 4, wherein the main body has an opening, one end of the pipe passes through the opening to enter into the main body, and the light emitting element is disposed at the end of the pipe.

7. The light emitting device with variable volume according to claim 1, wherein the main body comprises a balloon and a supporting body, and the balloon is sleeved on the supporting body.

8. The light emitting device with variable volume according to claim 7, wherein the supporting body is made of silica gel.

* * * * *